US009718582B2

(12) United States Patent
Hylton

(10) Patent No.: US 9,718,582 B2
(45) Date of Patent: Aug. 1, 2017

(54) MULTIPLE CHAMBER FLUID CONTAINER

(71) Applicant: Ricardo A. Hylton, Highland, CA (US)

(72) Inventor: Ricardo A. Hylton, Highland, CA (US)

( * ) Notice: Subject to any disclaimer, the term of this patent is extended or adjusted under 35 U.S.C. 154(b) by 27 days.

(21) Appl. No.: 14/967,952

(22) Filed: Dec. 14, 2015

(65) Prior Publication Data

US 2016/0114937 A1 Apr. 28, 2016

Related U.S. Application Data

(63) Continuation-in-part of application No. 13/604,499, filed on Sep. 5, 2012, now abandoned, which is a continuation-in-part of application No. 11/985,363, filed on Nov. 15, 2007, now abandoned.

(51) Int. Cl.

| | |
|---|---|
| ***A47G 21/18*** | (2006.01) |
| ***B65D 25/04*** | (2006.01) |
| ***A47G 19/22*** | (2006.01) |
| ***B65D 21/02*** | (2006.01) |
| ***A47G 19/23*** | (2006.01) |
| ***B65D 47/08*** | (2006.01) |
| *A47G 19/12* | (2006.01) |

(52) U.S. Cl.

CPC ..... *B65D 25/04* (2013.01); *A47G 19/2205* (2013.01); *A47G 19/2272* (2013.01); *A47G 19/2288* (2013.01); *A47G 19/23* (2013.01); *A47G 21/18* (2013.01); *B65D 21/0233* (2013.01); *B65D 47/089* (2013.01); *B65D 47/0857* (2013.01); *A47G 2019/122* (2013.01); *B65D 2543/00046* (2013.01)

(58) Field of Classification Search

CPC .. B65D 25/04; B65D 47/089; B65D 47/0857; B65D 2543/00046; A47G 19/2272; A47G 21/18; A47G 2019/122

USPC ..... 220/714, 713, 711

See application file for complete search history.

(56) References Cited

U.S. PATENT DOCUMENTS

| | | | |
|---|---|---|---|
| 585,057 | A | 6/1897 | Stone |
| 585,058 | A | 6/1897 | Stone |
| 2,531,855 | A | 11/1950 | Loptson |
| D182,721 | S | 5/1958 | Howes |
| D199,661 | S | 12/1964 | Rosen |
| 3,260,462 | A | 7/1966 | Smaczny |
| 4,301,942 | A | 11/1981 | Kupperman |
| 4,379,511 | A | 4/1983 | del Fabro |
| 4,816,268 | A | 3/1989 | Tsau |
| 4,955,503 | A | 9/1990 | Propes |
| 5,125,534 | A | 6/1992 | Rose et al. |
| 5,160,087 | A | 11/1992 | Mandell |
| 5,427,316 | A | 6/1995 | Leone |
| 5,588,561 | A | 12/1996 | Ness |
| 5,593,052 | A | 1/1997 | McGee |
| 5,753,289 | A | 5/1998 | Ness |

(Continued)

*Primary Examiner* — Stephen Castellano

(74) *Attorney, Agent, or Firm* — Kirk A. Buhler; Buhler & Associates

(57) ABSTRACT

A multiple chamber stackable cup or bottle has an air space separation between the chambers. A rotatable cap with a single sealable spout pivots to access each chamber individually. Alternately, a stationary cap has multiple sealable openings, one for each chamber, which communicate one chamber at a time or can be placed to bridge both chambers to allow access to both chambers at the same time. Tapered bodies enable the multiple chamber bodies to be stacked in a nested array.

8 Claims, 8 Drawing Sheets

(56) References Cited

U.S. PATENT DOCUMENTS

| | | | | |
|---|---|---|---|---|
| 5,758,786 | A | 6/1998 | John | |
| 5,890,627 | A | 4/1999 | Storey | |
| D409,442 | S | 5/1999 | Kilpatrick et al. | |
| 5,947,323 | A | 9/1999 | Freek et al. | |
| 6,042,018 | A | 3/2000 | Weinstein | |
| 6,079,586 | A | 6/2000 | Hanneman | |
| 6,152,862 | A | 11/2000 | Hobbs | |
| 6,769,573 | B1 | 8/2004 | Kazarian | |
| 6,820,767 | B2 | 11/2004 | Nicholas | |
| 6,863,193 | B2 | 3/2005 | Grossenbacher | |
| 6,913,777 | B2 | 7/2005 | Rebhorn | |
| 7,036,684 | B1 | 5/2006 | Hantman | |
| 7,090,097 | B1 | 8/2006 | Kazarian | |
| 7,172,533 | B2 | 2/2007 | Hobbs | |
| 2002/0074347 | A1 | 6/2002 | Murray | |
| 2006/0021996 | A1 | 2/2006 | Scott | |
| 2006/0032776 | A1* | 2/2006 | Klein | A47G 19/23 206/520 |
| 2006/0065660 | A1 | 3/2006 | Kalaouze | |
| 2006/0131311 | A1 | 6/2006 | Wang | |
| 2006/0175350 | A1 | 8/2006 | Abramson | |
| 2007/0029275 | A1 | 2/2007 | Hantman | |
| 2010/0314464 | A1 | 12/2010 | Markley | |

* cited by examiner

MULTIPLE CHAMBER FLUID CONTAINER

CROSS REFERENCE TO RELATED APPLICATION

This application is a continuation-in-part of applicant's application Ser. No. 13/604,499 filed Sep. 5, 2012, now abandoned, and is a continuation-in-part of application Ser. No. 11/985,363 filed Nov. 15, 2007, now abandoned, the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in fluid containers and particularly to a multiple chamber stackable cup or bottle having an air space separation between the two chambers and a rotatable cap with a single spout thereon or a stationary cap with multiple openings, one for each chamber, which communicate with the interior of only one of the chambers at a time.

Description of Related Art Including Information Disclosed Under 37 CFR 1.97 and 1.98

A number of patents and or publications have been made to address drink contains from multiple compartments. Exemplary examples of patents and or publication that try to address this/these problem(s) are identified and discussed below.

U.S. Patent Application #20060175350, published Aug. 10, 2006 by Abramson; shows a multi-compartment container. This invention includes a container and method for dispensing a single liquid out of the container that can store more than one liquid. The container includes a first compartment to store a first liquid and a second compartment to store a second liquid. The container also includes an opening and a rotatable piece having a liquid release opening. The container additionally includes a control connected to the rotatable piece enabling the first liquid or the second liquid to be dispensed from the opening of the container by rotating the rotatable piece so that the liquid release opening aligns with one of the first compartment and the second compartment.

U.S. Pat. No. 6,820,767, issued Nov. 23, 2004 to Nicholas, indicates a container assembly for storing and dispensing food items and beverages having a vessel and a removable lid. The vessel defines a longitudinal axis and has a first tongue and groove member. The removable lid has a lid aperture for accessing an interior of the vessel, and a complementary mating second tongue and groove member that is rotatable with the lid about the longitudinal axis and relative to the first tongue and groove member of the vessel between a lid secured configuration and a lid releasing configuration. In the lid secured configuration, the tongue and groove members fully engage one another, preventing longitudinal movement of the lid member relative to the vessel. In the lid releasing configuration, the tongue and groove members are configured so as to permit longitudinal movement of the lid member relative to the vessel, and such that the lid member is removable from the vessel.

U.S. Pat. No. 5,758,786, issued Jun. 2, 1998 to John, is for a multi-compartment baby bottle having a container that is divided into multiple compartments by a series of vertically extending partitions radiating from the central axis of the container. A nipple is attached to a collar which in turn, is attachable to the mouth of the container. The nipple includes a base portion having an aperture radially offset from the central axis of the nipple and which is adapted to register with only one of the compartments depending upon the relative angular orientation of the nipple and the collar. A series of L-shaped slots is provided on the collar with the slots being evenly spaced about the periphery of the collar and with the number thereof corresponding to the number of internal compartments in the container. The inside surface of the nipple sidewall carries a like number of projections evenly spaced about the inside periphery thereof and adapted to engage corresponding L-shaped slots on the collar. To change the angular orientation of the nipple and collar, the nipple is counter-rotated to unlock and disengage the projections from the slots. The nipple may then be rotated to a new relative angular position relative to the collar, and locked relative to the collar by causing the projections to engage the slots in the new orientation. Each time the relative angular orientation of the nipple is changed relative to the collar, the aperture in the base portion registers with a different vertical compartment thereby allowing the fluid only in that compartment to be discharged through the nipple.

U.S. Pat. No. 5,890,627, issued Apr. 6, 1999 to Storey, shows an apparatus, adapted for use with commercial sales containers containing dry powdered or granular materials, for metered dispensing of portions of the container volume, while sealing the container between uses. A divider comprising multiple vanes is inserted into a container. The vanes run generally vertically and contact the bottom and inner wall of the container when in place, forming a plurality of compartments within the container. The upper edges of the vanes are substantially even with the top edge of the container. The divider is made of flexible, washable material. A lid having a circumferential distensible lip snaps atop the container, the lower surface of the lid contacting the upper edges of the vanes. The lid may be rotated while in place atop the container, and has an opening which may be aligned over one of the compartments formed by the divider. A generally funnel-shaped top attaches to the lid, with a sealing cap permitting sealed storage of the container between servings. By rotating the lid and funnel top assembly to align the opening over one of the compartments, the contents of the compartment may be poured out while retaining the powdered materials in the remaining compartments in the container. In one embodiment, the apparatus is especially adapted for use with commercial sales containers of powdered infant food ("baby formula").

U.S. Pat. No. 6,079,586, issued Jun. 27, 2000 to Hanneman, discloses a combination cup and food container for holding a liquid beverage and a dry food snack in a single unit. The combination cup and food container includes a container having an open top and a partition dividing the container into a pair of compartments. A lid substantially covers the top of the container. The lid has an upwardly extending mouth spout forming an opening through the lid. The mouth spout is positioned above a first of the compartments of the container to permit liquids in the first compartment to pass through the mouth spout. The lid has a hole there through. The hole of the lid is positioned above a second of the compartments of the container. The lid has a flap substantially covering the hole of the lid. The flap is pivotally coupled to the lid.

Two U.S. patents, U.S. Pat. No. 5,753,289 issued May 19, 1998 and U.S. Pat. No. 5,588,561 issued Dec. 31, 1996 to Ness, concern a portable food container and method for storing and dispensing dry and liquid food. The container allows an individual to consume a combination of dry cereal and cold milk in a remote location away from the kitchen without the use of a bowl and a spoon. The portable food container is inverted to allow dry cereal to flow therefrom, and squeezed to allow milk to flow therefrom.

U.S. Pat. No. 5,593,052, issued Jan. 14, 1997 to McGee, provides a baby bottle with two separate fluid chambers. The divided fluid container allows the storage of two fluids, such as milk and juice, in a single baby bottle. A stopper, attached to an annular flange of a flexible nipple, is inserted into the opening of the cavity on one side of the bottle, preventing passage of fluid. A threaded collar, similar that used with prior art baby bottles, presses the flange of the nipple against the rim of the bottle, making a fluid-tight seal. A ring, supported by a stem connected to an anchor inside the stopper, allows the user to remove the stopper when desired, after removal of the threaded collar. The stopper may then be inserted into the opening of the second side of the bottle. The nipple, attached to the stopper, tends to prevent the stopper from being forced all the way into either half of the bottle.

Two U.S. patents, U.S. Pat. No. 7,090,097 issued Aug. 15, 2006 and U.S. Pat. No. 6,769,573 issued Aug. 3, 2004 to Kazarian, indicate a multi-chambered container fluid selection valve for use with a multi-chambered fluid container having outlet openings in communication with the fluid container chambers. The selection valve utilizes an outer housing having a bore for receiving a fluid from the multi-chambered container. An upper gasket engages an inner surface of the outer housing and an inner housing having intake ports that interface with the upper gasket, permitting communication between the outer housing and the fluid container. A spring detent is disposed upon the inner housing with protruding pins that ride upon a rotating detent ring. When the housing and the detent ring rotate, the pins enter radial grooves causing the housing to remain at a desired location. A closure assembly is snapped onto the inner housing to permit a fluid path to be formed between a specific compartment in the container and the bore in the outer housing.

U.S. Patent Application #20060131311, published Jun. 22, 2006 by Wang, is for a dual beverage container including a container body, dual pull tabs, and a partition such that two different beverages may be contained in one container.

U.S. Patent Application #20060021996, published Feb. 2, 2006 by Scott, provides a multi-chambered drink bottle for separately containing and delivering to the mouth of the user two or more liquids. Some embodiments comprise a mixing chamber wherein the liquids are mixed prior to being discharged through an orifice. Deformable containers permit the liquids to be delivered or forced into the mixing chamber by squeezing the sides of the bottle. In certain embodiments, check valves are provided to prevent the flow of liquid from the mixing chamber into the separate liquid containers.

U.S. Patent Application #20060065660, published Mar. 30, 2006 by Kalaouze, shows a multi-compartment fluid storage device allowing for multiple configurations to provide for different ratios of stored fluids. The device allows for each fluid to be stored separately from another until the container is opened or until each fluid is ready to be dispensed from said container. Further, multiple configurations provide for one or more tab member combinations to be in communication with each storage combination.

U.S. Patent Application #20070029275, published Feb. 8, 2007 by Hantman, claims a multiple chamber container. A diagonally divided bottle is disclosed, wherein the bottle includes at least two bottle sections separately formed, each bottle section including a bottom wall and outer wall extending therefrom defining a chamber. At least one portion of the outer wall of each bottle section has a portion adapted to mate with the portion of another bottle section. The mated portions of the bottle sections form at least one common wall. The common wall is arranged at an angle diagonal to a plane tangential to a front of the bottle such that products contained in the chambers of the bottle sections are simultaneously viewed when the diagonally divided bottle is observed from a front.

U.S. Patent Application #20020074347, published Jun. 20, 2002 by Murray, describes a multi-compartment container and dispensing device comprising a container having a septum extending from the bottom of the container up through the neck to the container opening. A closure seals the container from leakage and prevents internal contamination between compartments. The container may be blow molded in a single manufacturing step.

U.S. Pat. No. 6,863,193, issued Mar. 8, 2005 to Grossenbacher, puts forth a closing cap for two-chamber containers, which can be connected to an outlet opening of the container. The container is divided by a separating element, which extends up to outlet opening, so that the contents of the first chamber are supplied separately from the contents of the second chamber to the outlet opening. According to the invention, a detent connection is provided for joining the closing cap to the container, whereby a separating wall divides the closing cap into two separate areas. A separately closeable withdrawal opening is arranged in each area, and the separating wall interacts with the separating element as to connect each of the chambers of the container only to the area of the closing cap, in which the assigned withdrawal opening is located.

U.S. Pat. No. 6,913,777, issued Jul. 5, 2005 to Rebhorn, concerns a portable, side-by-side compartment container and method for separately storing and dispensing two consumable products, especially cereal and milk; the container includes a first compartment and a second compartment. The first compartment tapers at an upper portion thereof to form a spout. The spout facilitates dispensing of a contained first consumable product from the first compartment. The second compartment, in turn, tapers at an upper portion thereof to form a mouth. The mouth facilitates dispensing of a second consumable product from the second compartment. The first and second compartments are assembled to one another in a side-by-side fashion such that the spout abuts the mouth. With this configuration, during use, a first consumable product and a second consumable product can be dispensed from the container in close proximity to one another for convenient consumption. In one preferred embodiment, the first compartment contains a volume of milk and the second compartment contains a quantity of cereal.

U.S. Pat. No. 7,036,684, issued May 2, 2006 to Hantman, illustrates a diagonally divided bottle which includes an outer wall, a diagonal inner wall and a bottom wall. The outer wall and the bottom wall cooperate to form an interior divided by the inner wall. The inner wall intersects the outer wall and to the bottom wall to form a fluid tight seal between the divided interior, with the divided interior defining separate interior chambers. The inner wall is arranged at an angle diagonal to a plane tangential to the front of the bottle such that products contained in each interior chamber are simultaneously viewed when the bottle is observed from the front of the bottle. The invention also includes a twist-on or snap-on spout or nozzle, preferably of a tapered conical or cylindrical shape, and internally divided.

Two U.S. patents, U.S. Pat. No. 6,152,862 issued Nov. 28, 2000 and U.S. Pat. No. 7,172,533 issued Feb. 6, 2007 to Hobbs, claim a hand-held drink dispenser having a main housing and a parallel second housing that is a handle. Both are attached to a base plate and covered with a funneled cap having a funnel spout that is sized and shaped to fit in a user's mouth to funnel liquid from a plurality of reservoirs in the main housing and in the second housing. A cushiony support between the handle and the main housing helps hold the dispenser in order to relax holding grip for allowing the user to concentrate on physical activities and other concerns. Separate reservoirs prevent sloshing of the liquid and provide measured output from each of a pair of left-hand and right-hand units while also allowing balance of weight of liquid in each hand.

U.S. Pat. No. 4,301,942, issued Nov. 24, 1981 to Kupperman, describes an insulated container with a double wall construction having a removable partition centrally located within the container dividing the container into two compartments. A top is pivotally mounted on the partition and is constructed to close one of the compartments at a time. Liquid in one compartment flows to the other compartment through a connection provided at the bottom of the partition. The container, the partition and the top are all thermally insulated.

What is needed is a simple inexpensive multiple chamber container with fluid chambers separated by an open air space and tapered wall surfaces so that a number of the multiple chamber containers may be stacked together and a removable cap sealing the two chambers separately and sealable fluid access openings in the cap to access fluid individually from each of the separate fluid chambers while maintaining the other chamber sealed.

BRIEF SUMMARY OF THE INVENTION

It is an object of the present invention is to provide a simple inexpensive multiple chamber container with fluid chambers separated by an open air space and tapered wall surfaces so that a number of the multiple chamber containers may be stacked together and a removable cap sealing the two chambers separately and sealable fluid access openings in the cap to access fluid individually from each of the separate fluid chambers while maintaining the other chamber sealed.

In brief, the present invention provides a container with two separate chambers for holding fluids. The two sides can hold the same fluid or feature two different ones. Each chamber is self-contained with an air space separating the chambers so that one chamber could contain a cold liquid and the other container could contain a hot liquid.

The lightweight, easy to use configuration allows for various designs in shape, color and sizes to fit any need. The advantage of two different fluids in one container is very appealing to many consumers. The appeal to the children's market would provide a very useful product to many kids who are very picky about what they drink or its design would allow a smaller amount of fluid to be available at one time. The second or other side of the container could be refrigerated and consumed at a later time.

The present invention is a multiple chamber container for any types of fluids which could include, but not limited to, different beverages including hot and cold beverages, consumer products such as a shampoo and a conditioner or liquid soap and hand lotion, a mixable adhesive requiring two separate liquid or gel components mixed together at the moment of application, or any other type of fluids including powders or granular substances, such as salt and pepper, as well as liquids where having multiple chambers to retain them in a single container.

An advantage of the present invention is that it provides separated chambers to maintain different types and different temperature fluids.

Another advantage of the present invention is that it can be mass produced and shipped and stored efficiently and inexpensively.

Another advantage of the present invention is to allow the lid to be placed with the openings bridging two separate chambers. This allows for access to either of the two chambers from two separate opening thereby essentially providing four access points from only two openings.

Another advantage if the present invention is to provide a drinking straw that is split to allow access to both chambers through a single mixing straw.

One more advantage of the present invention is that each chamber can be accessed individually while leaving the other sealed.

Another advantage can be a cup with a triangular dividing section between the fluid areas to seal one or more of the lid openings.

Still another advantage is with a butterfly opening with separate bendable wings that can be separately or collectively opened to provide access to one or more fluid chambers.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

FIGS. 1-5, a multiple chamber fluid container 10 and 10A comprises a multiple fluid container body 30 and 30A having plural separate fluid chambers 34A and 34B, and a cap 20 and 20A with fluid access openings 26, 26A and 26B.

Figure 4:
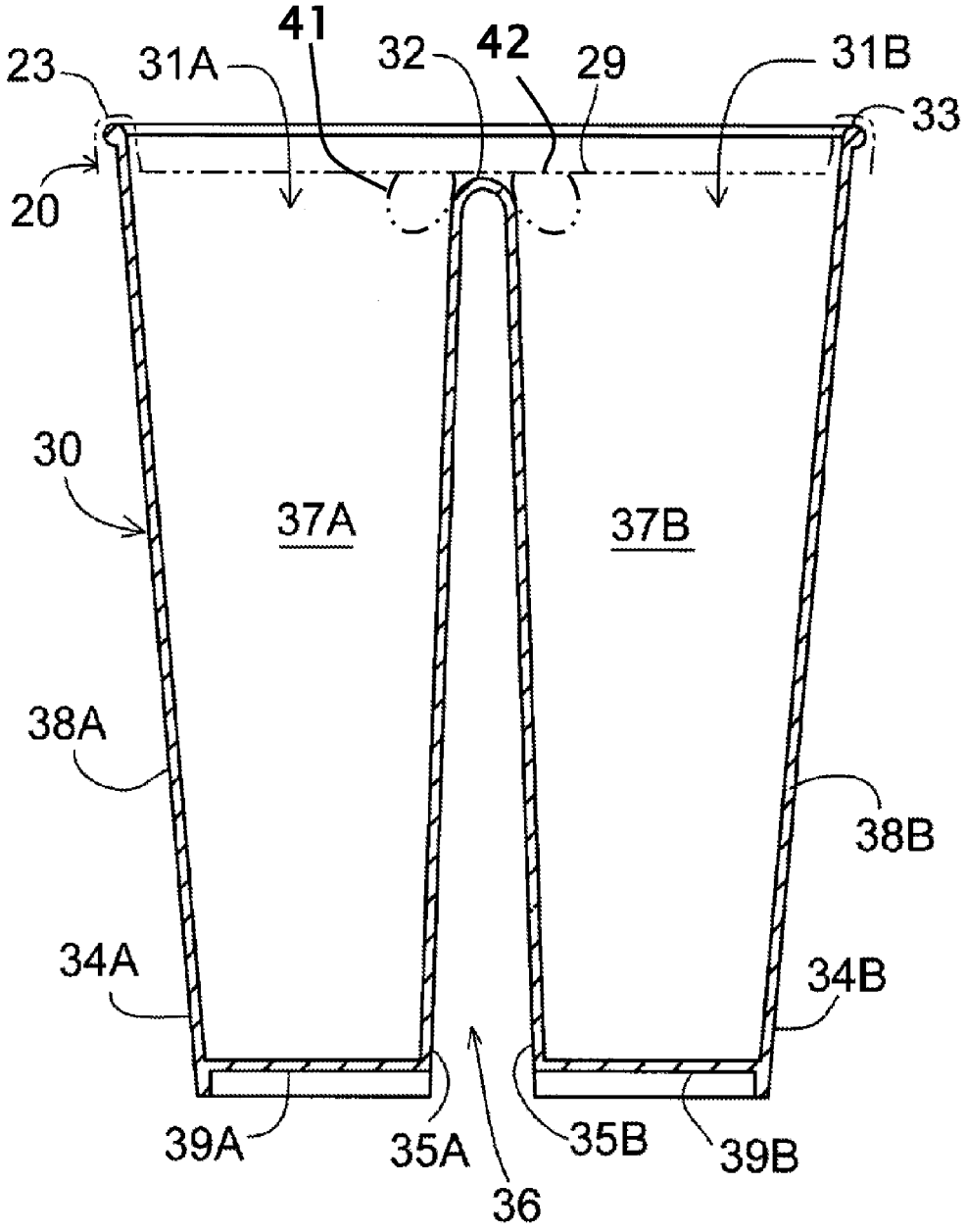
FIG. 4 is a cross-sectional view of a disposable cup embodiment of the multiple chamber fluid container of FIG. 1 showing the cap in dashed lines installed on the multiple chamber body with the cap resting on the interconnecting ridge between the chambers to seal both chambers with the peripheral channel snapped over the rim.
Figure 5:
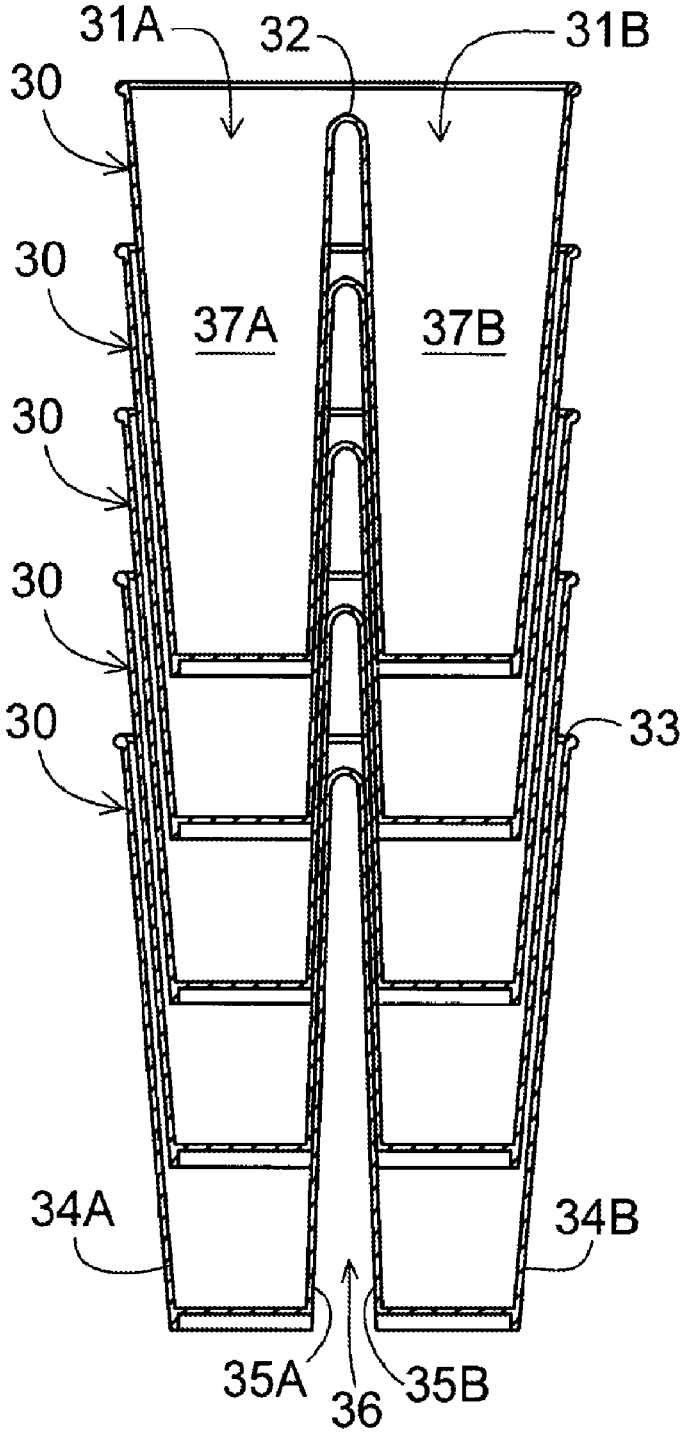
FIG. 5 is a cross-sectional view through a plurality of the multiple chamber bodies in a nested stack.
Figure 6:
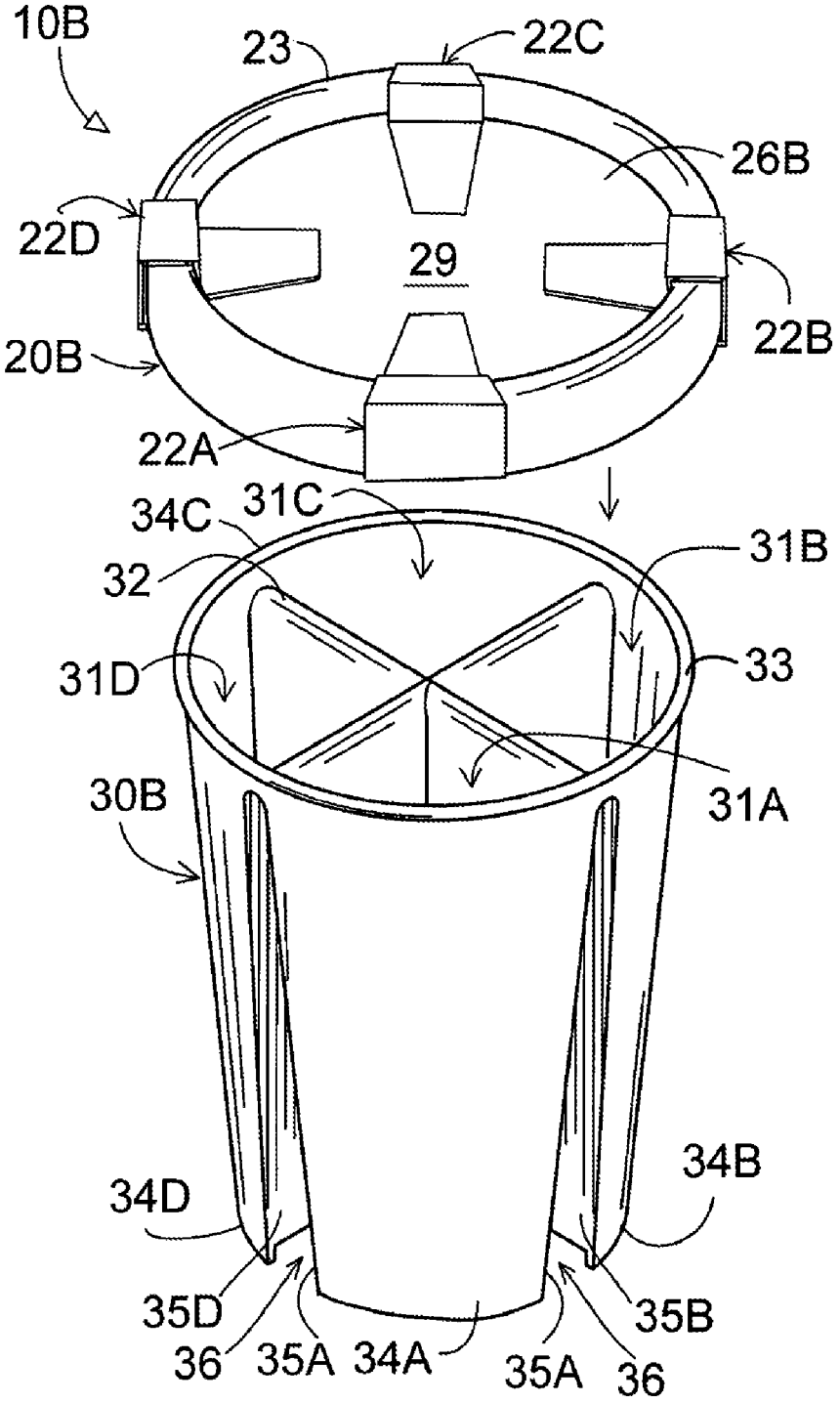
FIG. 6 is a perspective view of a four chamber embodiment of the multiple chamber fluid container of the present invention showing the cap elevated above the multiple chamber body aligned for installation thereon with four closable tabs over four access openings on the cap to align with the four chambers.

The multiple fluid container body 30 and 30A comprises a plurality of separate fluid chambers 34A and 34B, with at least two as shown in the drawings. Each fluid chamber 34A and 34B comprising surrounding walls 38A and 38B and a connected bottom 39A and 39B, enclosing an interior space 37A and 37B for containing fluids, and a top chamber opening 31A and 31B for accessing the interior space, as best seen in FIG. 4. A first fluid chamber 34A is spaced apart from the second fluid chamber 34B by an air space 36 between adjacent wall portions 35A and 35B. The separate fluid chambers 34A and 34B are interconnected at the top chamber opening by an interconnecting ridge 32 between the adjacent wall portions 35A and 35B and a common top lip 33 at a top edge of non-adjacent wall portions to form a larger shared fluid container body opening defined by the top lip 33 accessing the top chamber openings 31A and 31B of each of the separate fluid chambers 34A and 34B respectively. Each of the separate fluid chambers 34A and 34B is configured with tapering wall surfaces narrower at the bottom to allow the multiple chamber bodies 30 to be stacked in a nested array for storing or shipping empty containers, is seen in FIG. 5.

Figure 1:
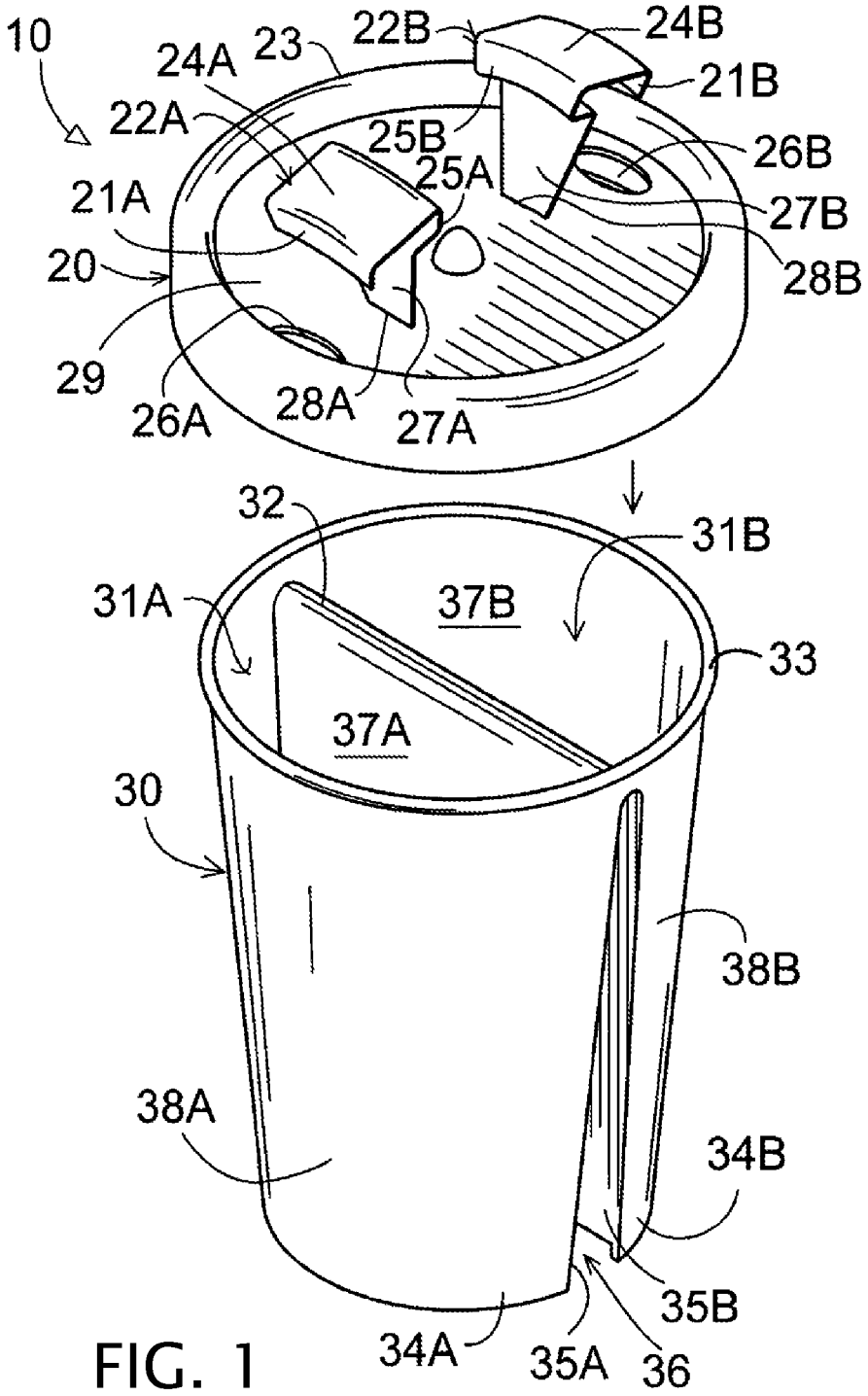
FIG. 1 is a perspective view of a disposable cup embodiment of the multiple chamber fluid container of the present invention showing the cap with multiple fluid access openings with closeable tabs elevated above the multiple chamber body aligned for installation thereon.
Figure 2:
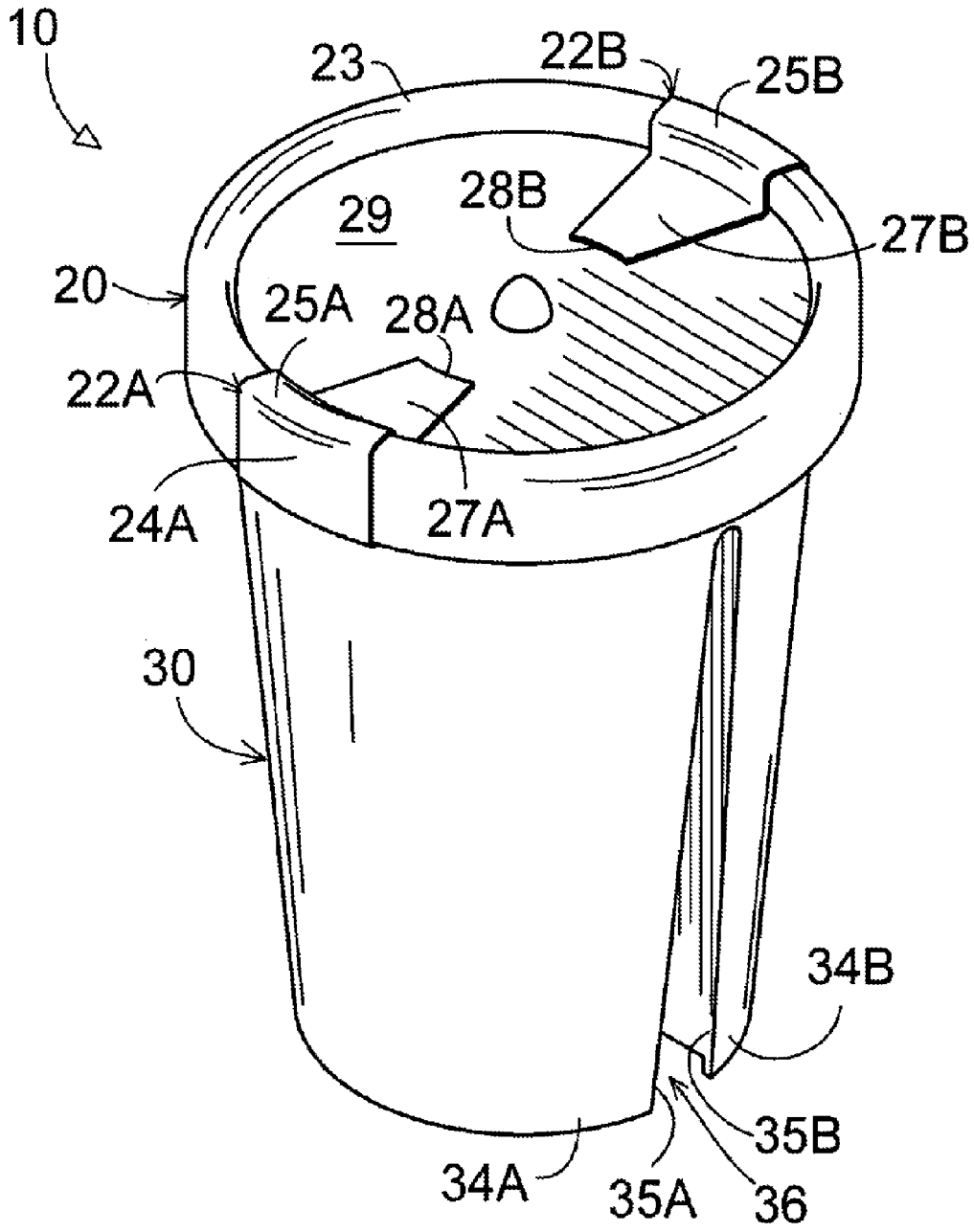
FIG. 2 is a perspective view of the multiple chamber fluid container of FIG. 1 showing the cap installed on the multiple chamber body.
Figure 3:
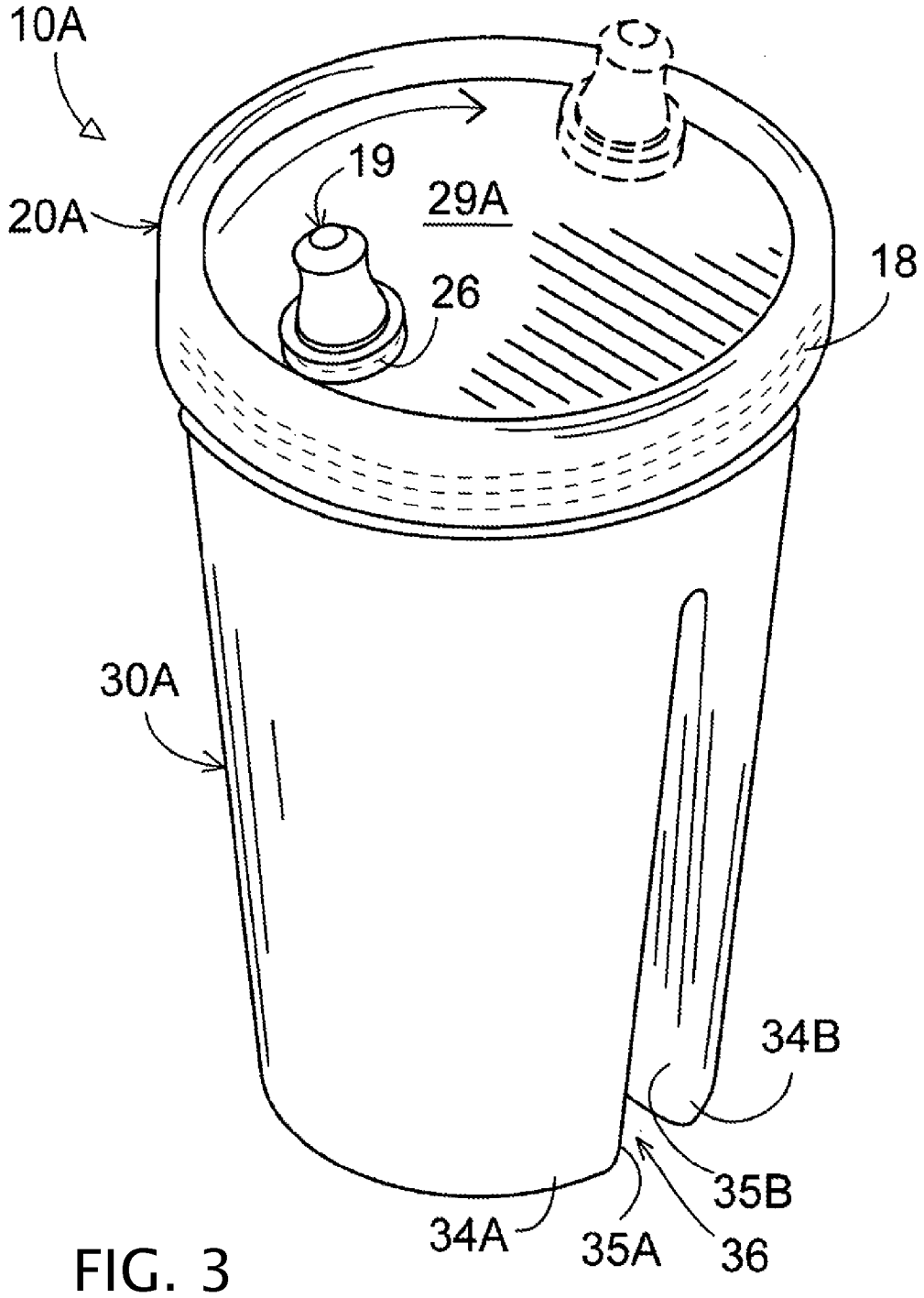
FIG. 3 is a perspective view of a re-usable bottle embodiment of the multiple chamber fluid container of the present invention showing the rotatable cap with a single fluid access spout installed on the multiple chamber body.

The cap 20 and 20A comprises a top surface 29 and 29A and a surrounding downwardly facing channel 23, in the embodiment of FIGS. 1 and 2, or a threaded connector 18, in the embodiment of FIG. 3, around an outer edge of the top surface. The channel 23 or threaded connector 18 removably mating with the shared top lip 33 to seal the multiple fluid container opening.

In FIG. 4, a means for sealing each of the at least two fluid chambers 34A and 34B to retain a fluid therein separately from a fluid in any other fluid chamber comprises a portion of the cap top surface 29 contacting the interconnecting ridge 32 between the adjacent wall portions to separate the top chamber openings 31A and 31B of the fluid chambers. The cap 20 is shown with a configurable bifurcated tab that is alterable to allow access to one or both chambers. In this figure, tabs 41 and 42 are shown bent into fluid chambers 37A and 37B respectively. The interior wall portions have an air space between adjacent wall portions is the angled wall portions form a triangular land between the fluid chambers where the land provides a seal to a cap opening.

The top surface 29 and 29A of the cap 20 and 20A has a least one, fluid access opening 26, 26A and 26B formed in the top surface for accessing the interior spaces 37A and 37B each of the separated fluid chambers.

Means are provided for accessing one of the access openings 26, 26A and 26B at a time to access one of the separated fluid chambers while maintaining the other of the separated fluid chambers sealed closed to retain a fluid therein. In FIGS. 1 and 2, showing a disposable cup embodiment of the multiple chamber fluid container 10, the cap 20 has a separate fluid access opening 26A and 26B for each of the separate fluid chambers 34A and 34B, and the means for accessing one of the at least one fluid access opening at a time comprises a sealing tab 22A and 22B over each of the separate fluid access openings. In FIG. 3, showing a bottle embodiment of the multiple chamber fluid container 10A, the cap 20A has a single fluid access opening 26 and the means for accessing one of the at least one fluid access opening at a time over a fluid chamber comprises a rotatable cap surface top 29A to rotate the single fluid access opening 26 over each of the separate fluid access openings one at a time and the cap further comprises a sealable fluid access spout 19 over the fluid 19 access opening.

In the disposable cup embodiment of the multiple chamber fluid container 10 of FIGS. 1 and 2, the multiple fluid container body 30 is fabricated of a thermally insulating disposable synthetic material, such as STYROFOAM and the cap 20 is fabricated of molded plastic, and the sealing tabs 22A and 22B are molded into the cap with living hinges 28A and 28B to open and close the sealing tabs 22A and 22B. A flat portion 27A and 27B of each of the sealing tabs covers the fluid access opening 26A and 26B and the sealing tab hooks over the outer channel 23 with a bottom hook tab 21A and 21B hooked under the outer channel 23 and an outer face 24A and 24B resting against an outer face of the outer channel 23 and a top surface 25A and 25B resting on top of the outer channel 23, as seen in FIGS. 1 and 2.

In FIG. 3, a reusable bottle embodiment the multiple chamber fluid container 10A the multiple fluid container body 20A is preferably fabricated of at least one material taken from the list of materials comprising glass, metal, plastic, synthetic foam or other fluid containing materials having durable waterproof qualities, which may have thermally insulated wall surfaces 35A, 35B, 38A and 38B fabricated with double layer wall surfaces having a thermally insulating substance between two surfaces of the double layer wall surfaces or fabricated of a thermally insulating material.

In use, the cap 20 and 20A may be removed to fill each of the separate fluid chambers 34A and 34B with a different fluid. The cap 20 and 20A seals each of the chambers separately to prevent mixing the fluids together. To access the fluids, a fluid access opening 26, 26A or 26B is opened over the desired chamber containing the desired fluid.

The multiple chamber container 10 and 10A of the present invention may be used for a variety of types of fluids which could include, but not limited to, different beverages including hot and cold beverages, consumer products such as a shampoo and a conditioner or liquid soap and hand lotion, a mixable adhesive requiring two separate liquid or gel components mixed together at the moment of application, or any other type of fluids including powders or granular substances, such as salt and pepper, as well as liquids where having multiple chambers to retain them in a single container.

Figure 7:
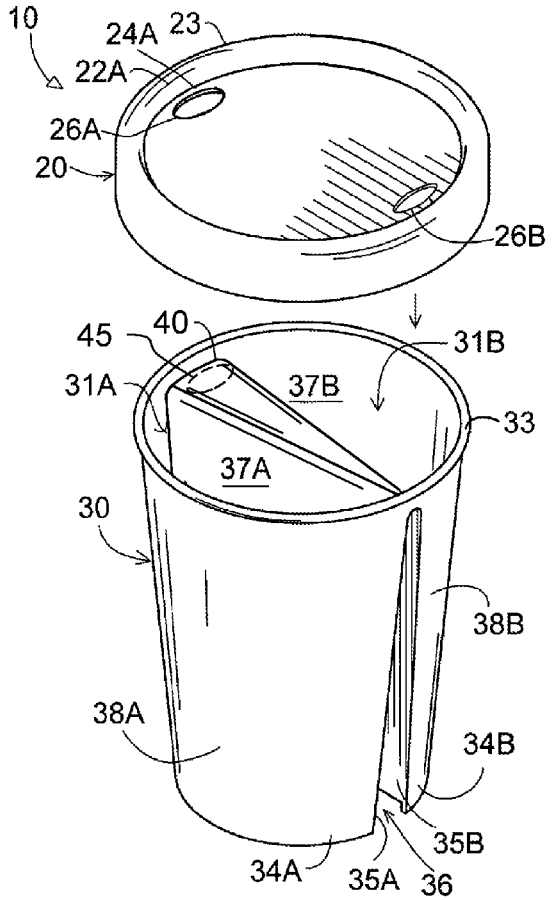
FIG. 7 is a perspective view of a two chamber embodiment showing the openings placed to allow access to both chambers.
Figure 8:
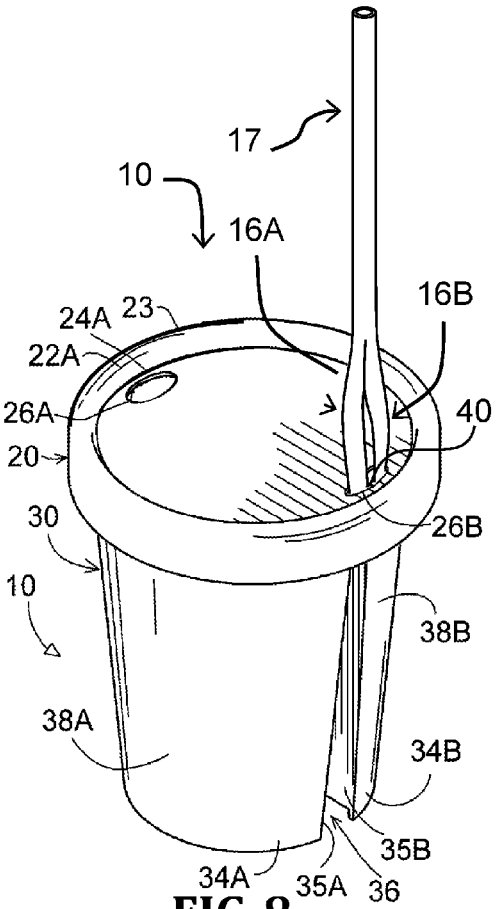
FIG. 8 is a perspective view of a two chamber embodiment showing the lid installed and a split mixing straw shown that draws fluid from both chambers into a single pipe.

FIG. 7 is a perspective view of a two-chamber embodiment showing the openings 26A and 26B placed to allow access to both chambers 31A and 31B from either opening 26A and or 26B. FIG. 8 is a perspective view of a two-chamber embodiment showing the lid 20 installed on the cup 30 and a split mixing straw shown that draws fluid from two pipes 16A, 16B from both chambers 31A, and 31B into a single pipe 17. It is further contemplated that in this embodiment one of the openings 26A could be eliminated thereby still providing access to one or both chambers from the single opening 26B. The ridge 40 is shown having a narrow side and a wide side. This allows a lid with two openings to be positioned to seal one of the openings, as shown with the dashed line 45, where an opening sits on top of the wide side to provide some sealing of the opening 26A while leaving the opposing opening for the split straw 17 to enter both fluid chambers 37A and 31B. The cups remain stackable when properly clocked.

Figure 9:
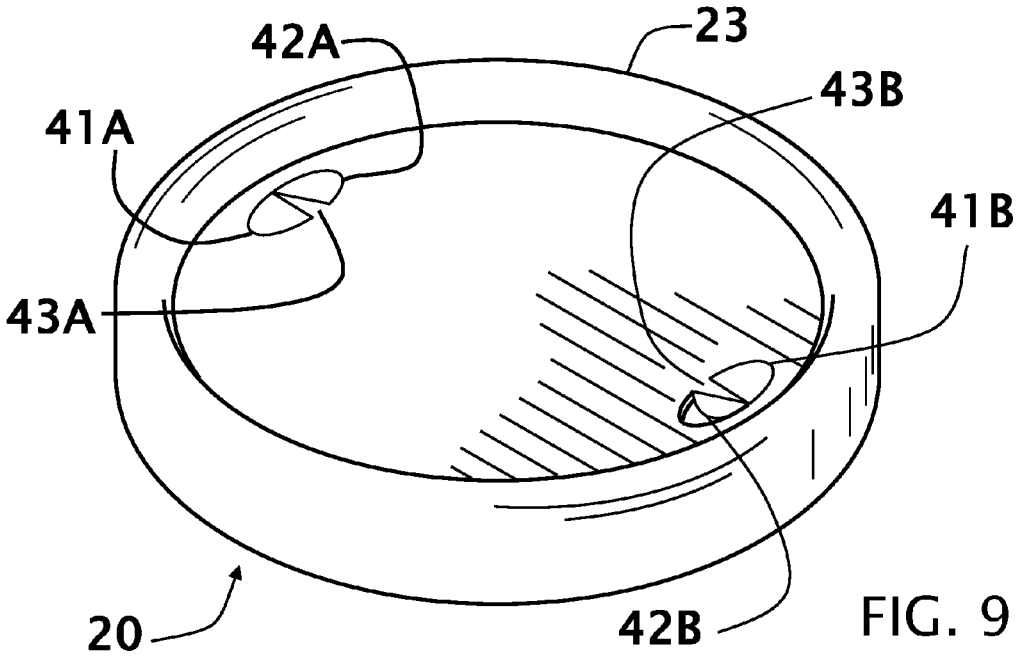
FIG. 9 is an outside perspective of a lid with a butterfly closure opening.
Figure 10:
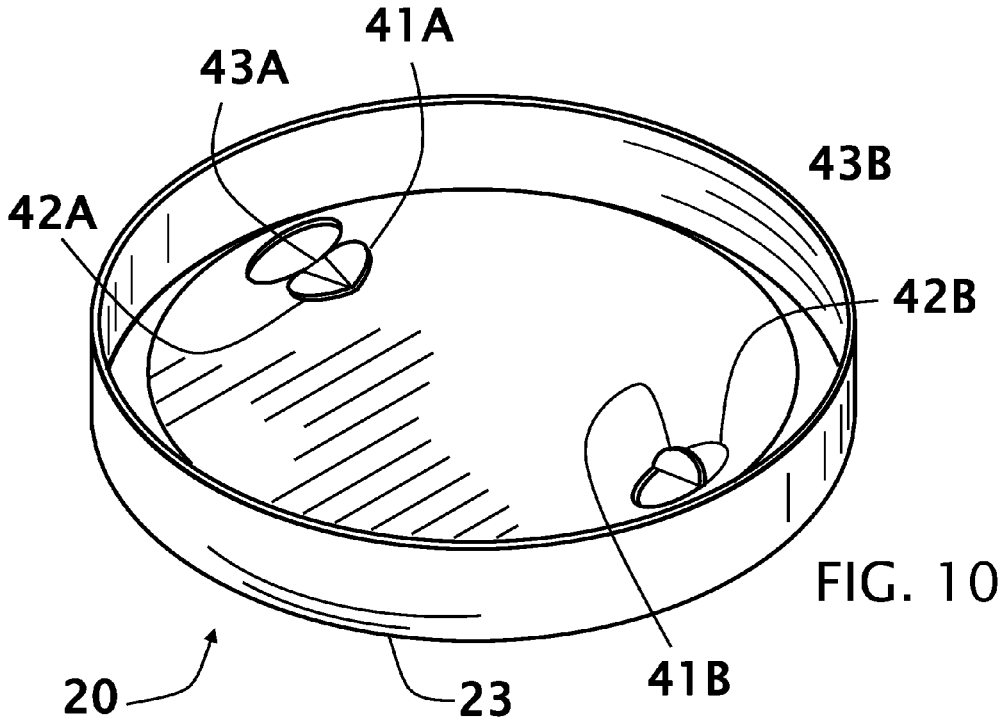
FIG. 10 is an inside perspective of a lid with a butterfly closure opening.

FIG. 9 shows a top view of the lid 20 with a butterfly opening and FIG. 10 shows an underside view of the lid 20 with the butterfly lid. In these figures, each opening has separate wing portions 42A, 43A and/or 42B, 43B. These wings can be independently opened as shown with 42B in FIGS. 9 and 41B in FIG. 10. One or more connecting folds or ribs can be used to join the wings. A body section connects the wings to the lid. The use of two folds allows each independent wing to essentially fold over the interconnecting ridge 32 or 40 (shown in the cup). The use of two folds allows the tabs to be retained on the lid 20 when both wings 41A and 42A are folded and turned on the lid 20 as shown in FIG. 10 to allow complete access through the lid 20. It is further contemplated that a user can fold the wings back into their original position to reseal the opening(s).

Thus, specific embodiments of a multiple chamber fluid container have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A multiple chamber fluid container comprising:

a multiple fluid container body comprising two separate fluid chambers each comprising separate surrounding walls and a separate bottom, each enclosing a separate interior space for containing a fluid;

a top chamber opening for accessing the interior spaces;

each fluid chamber comprising a separate body portion spaced apart from each other by an air space between adjacent wall portions;

each of the body portions having rigid surrounding walls and a rigid bottom to prevent contact between body portions to insulate each body portion to allow a fluid of one temperature to be contained in one of the two separate fluid chambers and a fluid of a different temperature to be contained in the other at least two separate chambers;

the two separate fluid chambers interconnected at the top chamber opening by an interconnecting ridge between the adjacent wall portions and a common top lip at a top edge of non-adjacent wall portions to form a larger shared fluid container body opening accessing the top chamber openings of each of the two separate fluid chambers;

said interconnecting ridge between the adjacent wall portions has a curved top surface;

each of the two separate fluid chambers configured with tapering wall surfaces narrower at the bottom to stack a plurality of fluid container bodies together in a nested array for storing or shipping empty containers;

a stackable cap comprising a planar portion and a downwardly facing channel surrounding an outer edge of the planar portion, the channel removably mating with the common top lip to seal the multiple fluid container opening and the planar portion of said cap sealing with the curved top surface of said interconnecting ridge so that said cap is configured for sealing each of the two fluid chambers to retain a fluid therein separately from at least a second fluid in any other fluid chamber;

two fluid access openings formed in the planar portion of said cap for accessing each of the interior spaces of the two separated fluid chambers;

at least one of said two fluid access openings has a butterfly sealing flap including two independently hinged wings, wherein said two independently hinged wings are connected to a both section of said butterfly sealing flap; and said cap is removed to change orientation of said cap thereby changing a location of said two fluid access openings on said two fluid chamber container, whereby said cap is removed and repositioned at any rotational position on said multiple fluid container body to provide access to one or both of said two separate fluid chambers simultaneously to access one or both of the two fluid access openings at a time to access both of the two separated fluid chambers from each of said two fluid access openings through said cap whereby said cap is positionable on said multiple fluid container body such that said two fluid access openings bridge said interconnecting ridge to allow access to each of the two fluid chambers through a single fluid access opening.

2. The multiple chamber fluid container of claim 1 wherein the sealing of each of the two fluid chambers comprises a planar flat portion of the cap contacting across all of the interconnecting ridge between the interior wall portions to separate the top chamber openings of the two fluid chambers.

3. The multiple chamber fluid container of claim 1 wherein the two separate fluid chambers are fabricated of a thermally insulating material.

4. The multiple chamber fluid container of claim 1 wherein said two independently hinged wings are hinged to said stackable cap.

5. The multiple chamber fluid container of claim 1 wherein said body section is hinged to the edge of said at least one fluid access opening.

6. The multiple chamber fluid container of claim 5 wherein said body section retains said two independent wings to said stackable cap.

7. The multiple chamber fluid container of claim 1 wherein said air space between adjacent wall portions is with angled wall portions with a triangular land between said two fluid chambers where said land provides a seal to one of said cap openings.

8. The multiple chamber fluid container of claim 7 wherein said land has an area that is larger in a width than a width of said two fluid access opening.

* * * * *